US008659487B2

(12) United States Patent
Fan et al.

(10) Patent No.: US 8,659,487 B2
(45) Date of Patent: Feb. 25, 2014

(54) ANTENNA MODULE AND METHOD FOR MAKING THE SAME

(75) Inventors: Yong-Fa Fan, Shenzhen (CN); Yong Yan, Shenzhen (CN); Qi-Yuan Li, Shenzhen (CN); Xue-Li Zhang, Shenzhen (CN); Zhao-Yi Wu, Shenzen (CN); Li Liu, Shenzhen (CN)

(73) Assignees: Shenzhen Futaihong Precision Industry Co., Ltd., Shenzhen (CN); FIH (Hong Kong) Limited, Kowloon (HK)

( * ) Notice: Subject to any disclaimer, the term of this patent is extended or adjusted under 35 U.S.C. 154(b) by 129 days.

(21) Appl. No.: 13/309,693

(22) Filed: Dec. 2, 2011

(65) Prior Publication Data

US 2012/0319905 A1 Dec. 20, 2012

(30) Foreign Application Priority Data

Jun. 16, 2011 (CN) ..... 2011 1 10162057

(51) Int. Cl.
*H01Q 1/24* (2006.01)
*H01Q 1/38* (2006.01)

(52) U.S. Cl.
USPC ..... 343/702; 343/700 MS

(58) Field of Classification Search
USPC ..... 343/702, 700 MS
See application file for complete search history.

(56) References Cited

U.S. PATENT DOCUMENTS

| | | | | |
|---|---|---|---|---|
| 7,345,645 | B2 * | 3/2008 | Cho | 343/878 |
| 8,203,491 | B2 * | 6/2012 | Yang et al. | 343/702 |
| 8,405,561 | B2 * | 3/2013 | Handy et al. | 343/705 |
| 2009/0173793 | A1 * | 7/2009 | Kojo et al. | 235/492 |

* cited by examiner

*Primary Examiner* — Hoang V Nguyen
(74) *Attorney, Agent, or Firm* — Altis Law Group, Inc.

(57) ABSTRACT

An antenna module includes a main body and an antenna radiator located on the main body. The antenna radiator is made of a liquid conductive material mixed by metal powders and diluting agent and is directly formed on the main body. A method for making the antenna module is also described.

13 Claims, 3 Drawing Sheets

ANTENNA MODULE AND METHOD FOR MAKING THE SAME

BACKGROUND

1. Technical Field

The present disclosure relates to antenna modules and methods for making the same, and particularly, to an antenna module used in a portable electronic device and a method for making the same.

2. Description of Related Art

Portable electronic device generally includes an antenna module to transmit and receive electromagnetic waves. Laser Direct Structuring (LDS) is a method recently used to manufacture antennas. Manufacturing antennas by LDS process commonly includes three steps: forming a plastic substrate using modified plastics which can be laser-activated to be conductive; focusing a laser on a predefined region of the surface of the plastic substrate to make metal crystals contained in the modified plastics spread to cover the predefined region; and depositing a conductive metal coating on the predefined region to form the antenna. The LDS antenna can be designed with many suitable three-dimensional shapes according to frequencies to be used. However, the modified plastics used for the LDS antennas are very costly and such process can reduce processing efficiency and increase production times.

Therefore, there is room for improvement within the art.

BRIEF DESCRIPTION OF THE FIGURES

Many aspects of the antenna module and method for making the same can be better understood with reference to the following figures. The components in the figures are not necessarily drawn to scale, the emphasis instead being placed upon clearly illustrating the principles of the antenna module and method for making the same. Moreover, in the drawings like reference numerals designate corresponding parts throughout the several views.

DETAILED DESCRIPTION

Figure 1:
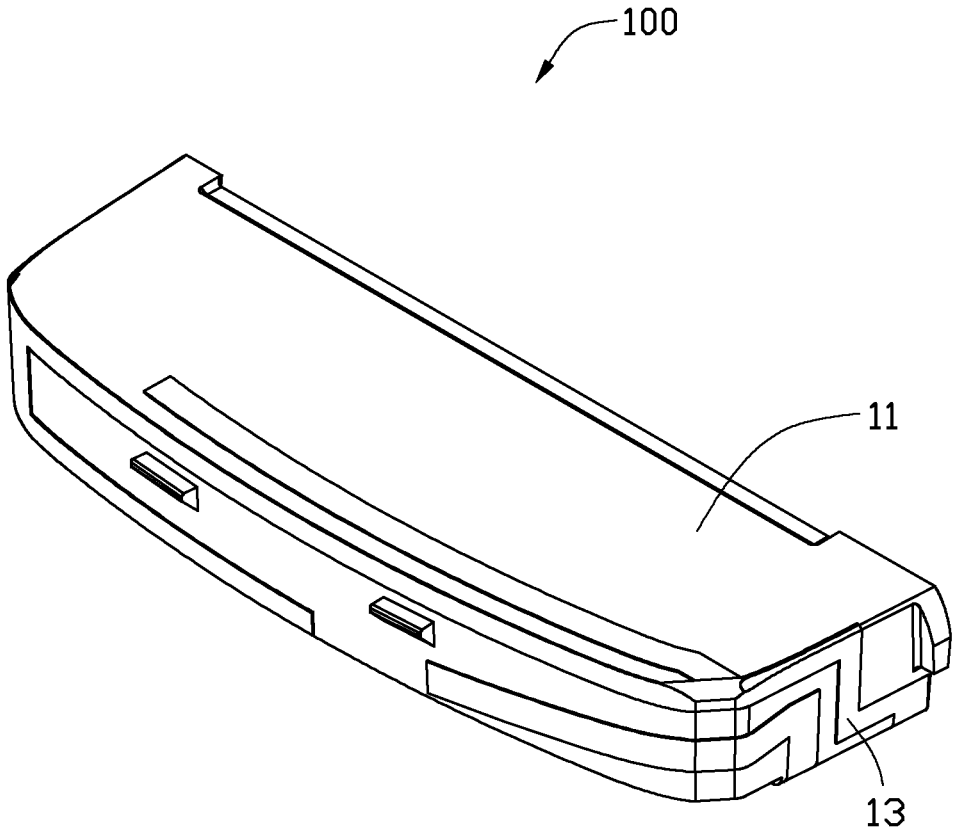
FIG. 1 is a schematic view of an antenna module, according to a first embodiment of the present disclosure.
Figure 2:
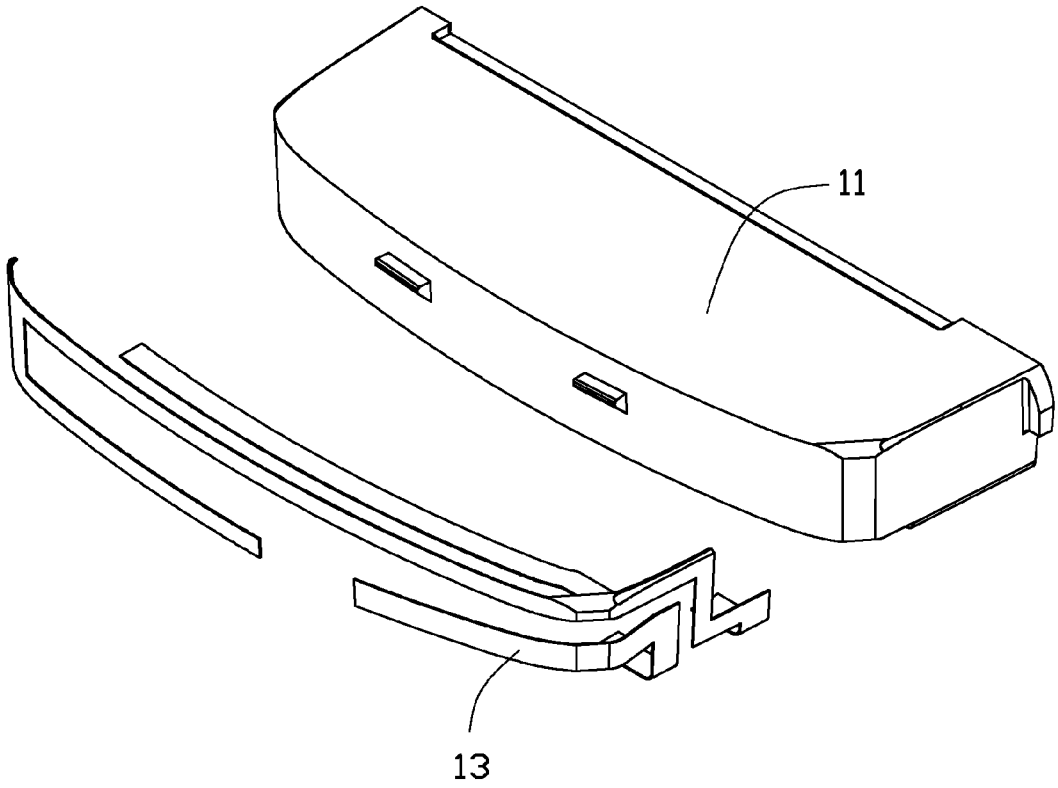
FIG. 2 is an exploded view of the antenna module shown in FIG. 1.

Referring to FIG. 1 and FIG. 2, an antenna module 100 according to a first embodiment of the present disclosure includes a main body 11 and an antenna radiator 13 located on the main body 11. In this embodiment, the antenna radiator 13 is three-dimensional.

The main body 11 is molded using non-conductive plastics. The non-conductive plastics may be one or more materials selected from a group consisting of polypropylene (PP), polyamide (PA), polycarbonate (PC), polyethylene terephthalate (PET), and polymethyl methacrylate (PMMA). The antenna radiator 13 is a conductive layer formed according to a predetermined shape. The conductive layer is made of metal, such as Silver (Ag) or Copper (Cu).

A method for manufacturing the antenna module 100 is described as follows:

The main body 11 is molded through injection molding. A dispenser (not shown) which allow a three-dimensional guidance of a nozzle of the dispenser is used for forming antenna radiator 13. The dispenser is an automatic device used to dispense a liquid or a paste on an object. A liquid or pasty conductive material mixed by Ag powders and a diluting agent is fed into the dispenser. The diluting agent is an organic solvent which is mainly made of xylene. The diluting agent can improve the liquidity of the conductive material for allowing the conductive material to get out from the nozzle of the dispenser.

A motion path of the nozzle and a flow of the conductive material got out from the nozzle are set up through programming on the dispenser. The motion path of the nozzle can be referred to as a predetermined path. In this embodiment, the predetermined path corresponds to the pattern of the antenna radiator 13. The flow of the conductive material can be set up through the dispenser according to a thickness parameter of the antenna radiator 13.

The conductive material is coated on the main body 11 by the dispenser according to the predetermined path. Subsequently, the main body 11 is baked at a temperature of about 70° C.~150° C. The main body 11 may be baked for a few hours. During baking, most of the diluting agent is volatilized, and the remaining is solidified. The baking effectively improves a bonding force between the conductive material and the main body 11. Accordingly, the antenna radiator 13 is formed on the main body 11.

The conductive material can be coated on the main body 11 according to a predetermined path, not limited by the shape of the main body, thus the antenna radiator 13 can be designed with many suitable shapes. Comparing with LDS antennas, the antenna module 100 can be more easily produced and has a lower cost.

Figure 3:
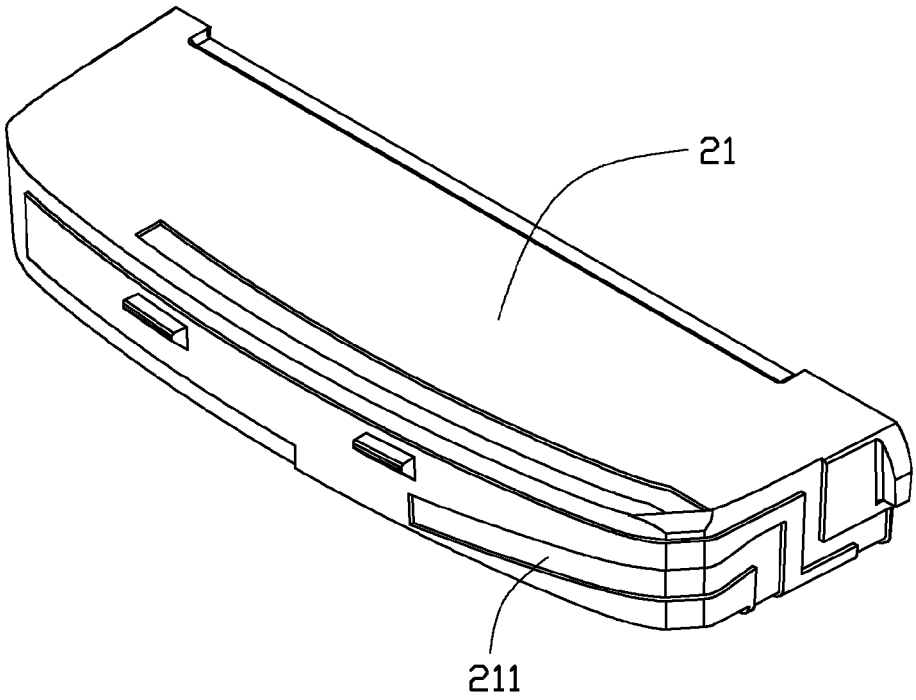
FIG. 3 is a schematic view of a main body of the antenna module, according to a second embodiment of the present disclosure.

Referring to FIG. 3, an antenna module according to a second embodiment of the present disclosure is similar to the above-described antenna module 100, differing in that a groove 211 is defined in a main body 21 during the injection molding. The shape of the groove 211 corresponds to a pattern of an antenna radiator (not shown) located on the main body 21. The above-described conductive material is filled in the groove 211 by a dispenser. Subsequently, the main body 21 is baked and the antenna radiator is formed on the main body 21.

It should be understood, however, that even though numerous characteristics and advantages of the present embodiments have been set forth in the foregoing description, together with details of the structures and functions of the embodiments, the disclosure is illustrative only, and changes may be made in detail, especially in matters of shape, size, and arrangement of parts within the principles of the present disclosure to the full extent indicated by the broad general meaning of the terms in which the appended claims are expressed.

What is claimed is:

1. An antenna module, comprising:

a main body; and an antenna radiator located on the main body;

wherein the antenna radiator is made of a liquid conductive material mixed by metal powders and diluting agent and is directly formed on the main body, the diluting agent is made of xylene.

2. The antenna module as claimed in claim 1, wherein the metal powders is made of Ag or Cu.

3. The antenna module as claimed in claim 1, wherein the main body is molded through injection molding.

4. The antenna module as claimed in claim 3, wherein the main body is made of plastics which are one or more materials selected from a group consisting of polypropylene (PP), polyamide (PA), polycarbonate (PC), polyethylene terephthalate (PET), and polymethyl methacrylate (PMMA).

5. The antenna module as claimed in claim 3, wherein the antenna radiator is three-dimensional, a groove corresponding to a pattern of the antenna radiator is defined on the main body, and the liquid conductive material is filled in the groove.

6. The antenna module as claimed in claim 5, wherein the predetermined path corresponding to the pattern of the antenna radiator is set up through programming on a dispenser.

7. The antenna module as claimed in claim 1, wherein the main body is baked at a temperature of 70° C.~150° C. to volatilize most of the diluting agent, and the remaining diluting agent is solidified.

8. A method for making an antenna module, the method comprising:

molding a main body;

coating a conductive material mixed by metal powders and diluting agent on the main body according to a predetermined path, the diluting agent made of xylene;

baking the conductive material to form an antenna radiator on the main body.

9. The method as claimed in claim 8, wherein the metal powders is Ag or Cu powders.

10. The method as claimed in claim 8, wherein the main body is made of plastics which are one or more materials selected from a group consisting of polypropylene (PP), polyamide (PA), polycarbonate (PC), polyethylene terephthalate (PET), and polymethyl methacrylate (PMMA).

11. The method as claimed in claim 8, wherein the antenna radiator is three-dimensional, a groove corresponding to a pattern of the antenna radiator is defined on the main body and the liquid conductive material is filled in the groove by a dispenser.

12. The method as claimed in claim 11, wherein during baking, most of the diluting agent is volatilized, and the remaining diluting agent is solidified.

13. The method as claimed in claim 12, wherein the main body is baked at a temperature of 70° C.~150° C.

* * * * *